United States Patent [19]

Manness et al.

[11] Patent Number: 4,627,378

[45] Date of Patent: Dec. 9, 1986

[54] FILL GATE FOR GRAIN BINS AND THE LIKE

[76] Inventors: Cecil E. Manness, Box 4, Domain, Manitoba, Canada, R0G 0M0; Leo J. Nolette, Box 195, St. Agathe, Manitoba, Canada, R0G 1Y0

[21] Appl. No.: 730,591

[22] Filed: May 6, 1985

[30] Foreign Application Priority Data

May 10, 1984 [CA] Canada ..... 453990

[51] Int. Cl.[4] ..... G01F 23/32; G01F 23/34

[52] U.S. Cl. ..... 116/229; 73/317; 73/322.5

[58] Field of Search ..... 73/317, 322.5, 318; 200/61.21; 116/229, 227, 228; 340/617

[56] References Cited

U.S. PATENT DOCUMENTS 2,612,181 9/1952 Muckala ..... 73/322.5

FOREIGN PATENT DOCUMENTS 672496 7/1979 U.S.S.R. ..... 200/61.21

*Primary Examiner*—Charles Frankfort
*Assistant Examiner*—Denis Corr
*Attorney, Agent, or Firm*—Stanley G. Ade

[57] ABSTRACT

A wedge shaped hollow float is mounted by one end to a channel bolted to the inside of the sloping roof of a grain bin approximately two feet from the top thereof. A curved rod is pivotally secured by the inner end thereof to the other end of the float and extends through the channel and through the roof and has an indicating disc on the outer end thereof. As the bin fills, the angle of repose of the grain engages the other end of the wedge shaped float and gradually lifts it as the bin continues to fill. When the indicator is fully extended, a rod and disc indicates to the operator that the flow of grain to the auger hopper should be shut off and the two foot space at the top of the bin is sufficient to hold the grain left in the auger and in the hopper thus avoiding any spillage.

16 Claims, 6 Drawing Figures

FILL GATE FOR GRAIN BINS AND THE LIKE

BACKGROUND OF THE INVENTION

This invention relates to new and useful improvements in fill gauges or indicators for grain bins and the like, particularly grain bins having a sloping roof.

Conventionally, such indicators take the form of a flat panel or the like which is lifted by the grain as the bin fills. These indicators are usually situated in the vertical side of the bin and only give an indication of when the level of the grain reaches that particular point. If a paddle is used on the sloping surface of the roof, then grain tends to get behind the paddle and prevents same from rising fully.

SUMMARY OF THE INVENTION

The present invention overcomes disadvantages with flat paddles and round or bottle shaped floats by providing a wedge shaped float which is engaged by the upper surface of the grain forming the angle of repose and gradually lifted to its fullest extent without any tendency of the float to become buried. It is efficient in this operation whether the grain is coarse, fine or slippery.

In accordance with the invention there is provided a fill indicator for grain bins and the like having a sloping roof comprising in combination a mounting member for securement to the sloping roof, a wedge shaped float pivotally secured by one end thereof to said mounting member to depend therefrom when installed, guide means secured adjacent the other end of said float and extending upwardly therefrom, and indicating means on the distal end of guide means.

Another aspect of the invention consists of a fill indicator for grain bins and the like having a sloping roof said indicator being secured to the inside surface of said sloping roof spaced from the upper end of said roof, said fill indicator including an elongated mounting member secured to said inner surface and extending substantially along the slope of said roof, means to secure said member to said inner surface, a wedge shaped float pivotally secured by one end thereof to adjacent an upper or higher end of said mounting member and depending therefrom, guide means secured to said other end of said float and extending upwardly therefrom, said guide means extending freely through said elongated member and through said roof, and indicating means on the distal end of said guide means.

Another advantage of the present invention is that it may be placed approximately two feet from the upper end of the sloping roof so that when the indicator shows the float fully lifted, there is sufficient space left in the grain bin to receive the contents of the auger assembly and the hopper so that spillage and waste of grain is avoided.

Conventionally, operators have to climb a ladder to the upper apex of a grain bin in order to ascertain whether or not the bin is nearly full. This is not only time consuming but can be extremely dangerous. If this action is not taken, however then grain spills from the apex and is wasted. Furthermore under these conditions, the entire auger tube assembly and the hopper is still filled with grain which has to be evacuated therefrom and is often spilled and lost.

The present invention overcomes these disadvantages and is usable with any grain bin having a sloping roof and is particularly suitable for the well-known cylindrical type grain bins with a cone shaped roof adapted to be filled by a grain auger extending to the apex of the roof.

Another advantage of the invention is that it is easily installed in existing grain bins whether they be in the field, in the farmyard or in seed plants or the like.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
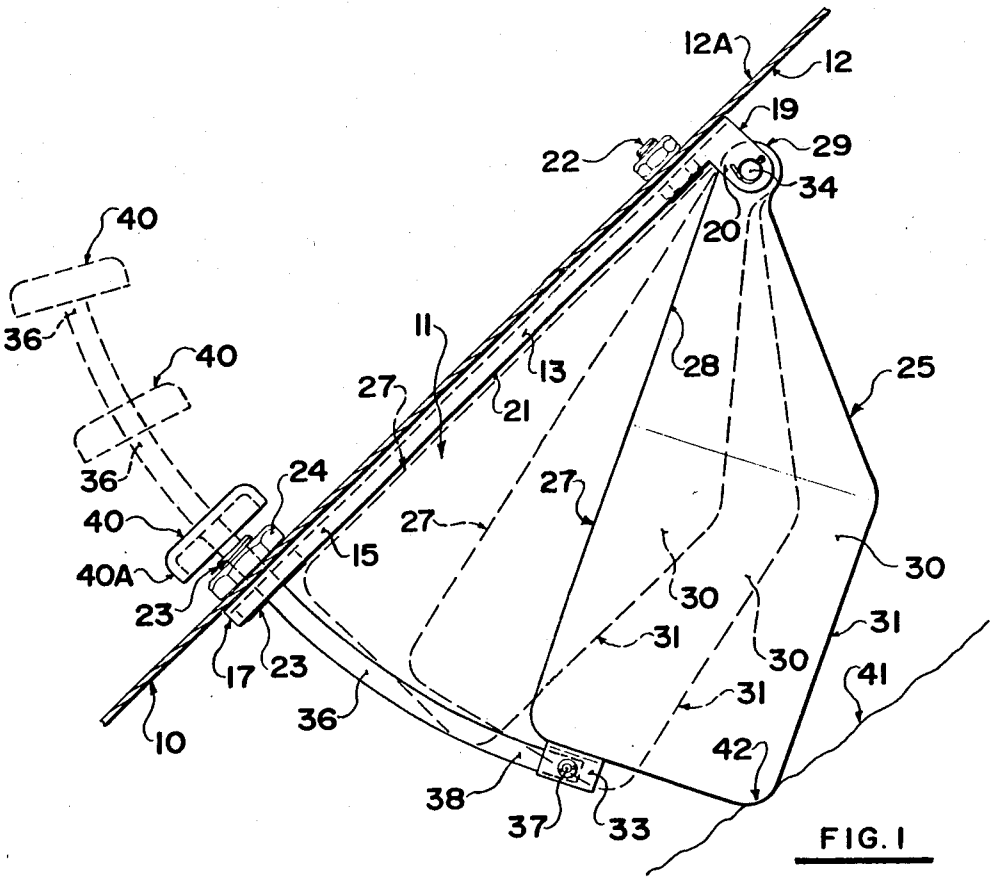
FIG. 1 is a partially schematic side elevation of the invention installed in a sloping section of a grain bin roof and showing the various positions of the indicator from the maximum down a position in full line and succeeding positions in phantom.
Figure 2:
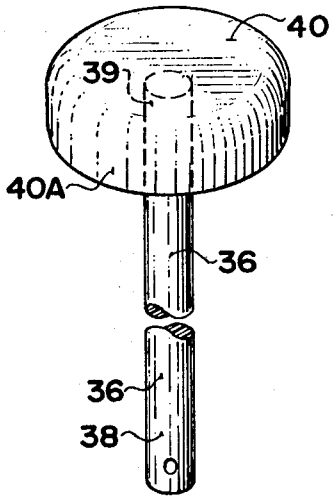
FIG. 2 is a fragmentary isometric view of the guide means and indicator.
Figure 3:
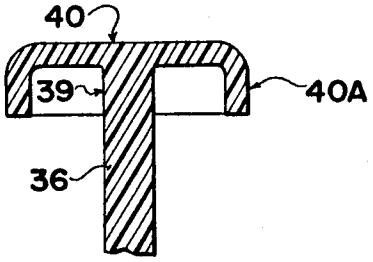
FIG. 3 is a cross sectional view of the indicator per se.

In order to describe the invention in detail, reference should first be made to FIG. 1 in which 10 indicates a section of a sloping roof of a conventional grain bin usually manufactured of corrugated metal or the like.

The device collectively designated 11 is situated on the inner surface of this sloping roof, said inner surface being indicated by reference character 12. It is preferably situated approximately two feet from the top or apex of the roof (not illustrated) in order to give sufficient room to empty the associated grain auger and hopper therefore which normally fills through the apex of the conical shaped grain bin roof.

Figure 4:
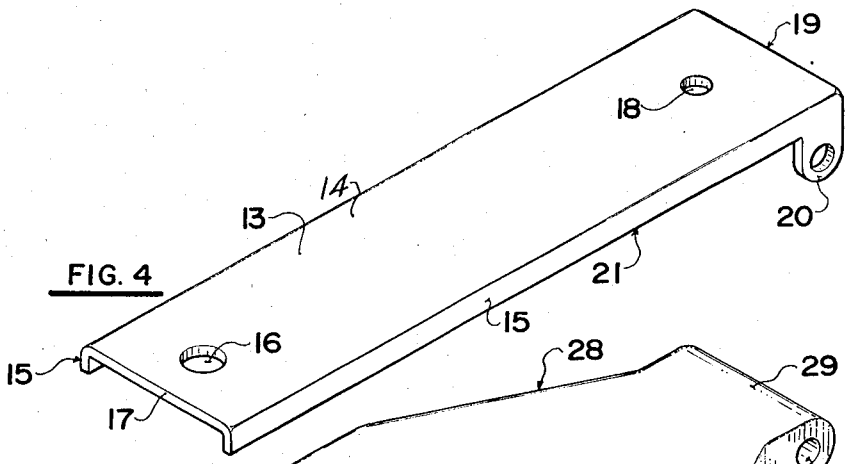
FIG. 4 is a fragmentary isometric view of the mounting member per se.
Figure 6:
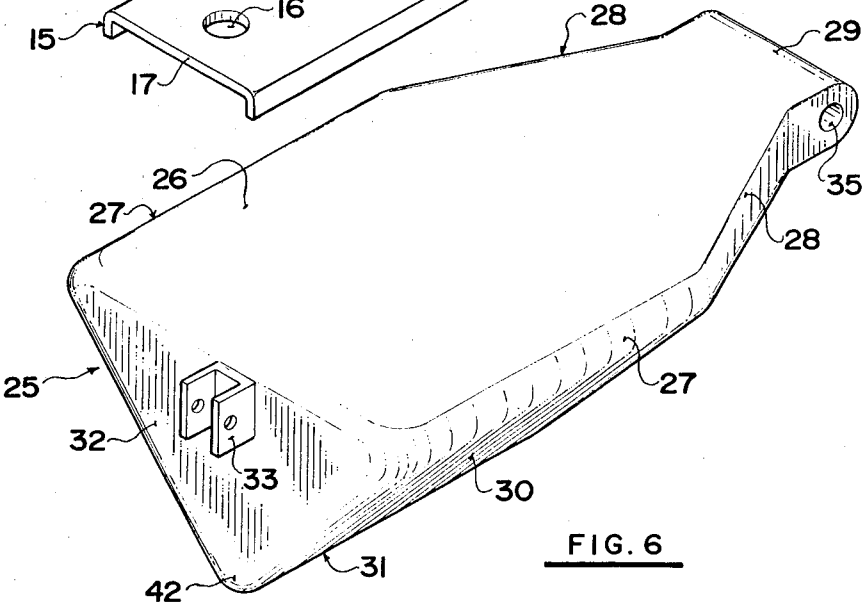
FIG. 6 is an isometric view of the float per se.
Figure 5:
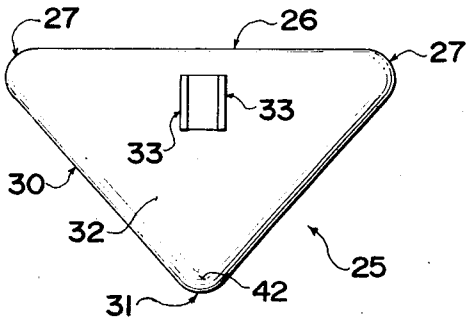
FIG. 5 is an end view of the float per se.

The invention consists of an elongated mounting member 13 which, this embodiment, takes the form of a length of channel shown in FIG. 4 and having a flat web portion 14 with a pair of spaced and parallel downwardly depending side flanges 15.

A relatively large aperture 16 is formed adjacent one end 17 of the web 14 and a smaller aperture 18 is formed through the web adjacent the other or upper end 19 of the web. A pair of apertured ears or lugs 20 extend downwardly from the lower edge 21 of the two side flanges adjacent the rear end 19 as clearly shown.

A nut and bolt assembly 22 extends through the aperture 18 and through a corresponding aperture in the sloping roof 10 thus bolting the channel to the inner surface 12 of the roof so that it lies along the slope of the roof as clearly shown.

A guide sleeve 23 is screw threaded on the outer end thereof and extends through aperture 16 and through a corresponding aperture within the roof 10 to receive a nut 24 on the outer end thereof thus clamping the lower end of the channel to the inner surface of the roof and at the same time clamping the guide sleeve in position, it being understood that the inner end of the guide sleeve is headed to prevent it from passing clear through the aperture 16.

A float collectively designated 25 is formed from plastic and is preferably hollow. It may also be formed of relatively thin metal but it has been found that a hollow plastic shell is preferable.

This float comprises a relatively planar upper surface 26 with the side edges 27 terminating in inwardly converging portions 28 which extend towards a rear portion 29 which is transversely apertured and mounts the float for pivotal movement as will hereinafter be described.

Sides 30 extend downwardly and inwardly from the side edges 27 and 28 and terminate in a keel portion 31 substantially parallel to said upper surface and extending from the other end portion towards the rear portion, thus defining a substantially triangular other end portion 32 that is at the opposite end of the float assembly from the rear end portion 29. The keel inclines upwardly towards the rear end portion from a location below where the side edges commence to converge and the sides 30 also commence to converge rearwardly from this location. All of the edges of this embodiment are curved and a pair of spaced and parallel apertured lugs 33 extend from the end portion 32 as clearly shown.

In order to mount the float assembly, a pivot pin 34 extends through the aperture 35 in the portion 29 of the float and through the aforementioned aperture lugs 20 at the upper end 19 of the channel 13 thus pivoting the float as clearly shown in FIG. 1.

Guide means taking the form of a outwardly curved rod 36 is pivotally secured by pivot pin 37 adjacent the lower end 38 thereof, between the lugs 33 and extends upwardly through the guide sleeve 23 secured adjacent the lower or other end 17 of the channel terminating exteriorly of the roof panel portion 10. It terminates in an indicator which not only indicates the location of the float but also prevents the float from moving further downwardly than the position shown in solid line in FIG. 1.

The indicator in this particular embodiment consists of a disc secured by the center thereof to the upper or distal end 39 of the rod 36. It is preferably downwardly curved at the perimeter thereof as indicated by reference character 40A so that when in the lowermost position, it covers the upper end of the guide sleeve 23 and prevents moisture from entering around the rod 36.

In operation, the float assembly is mounted as previously described, to the sloping roof 10 and when the grain bin is empty, it depends to the position shown by the solid line in FIG. 1.

As the bin is filled from the apex thereof, the surface of the grain follows the angle of repose indicated by reference character 41 in FIG. 1. As it reaches the lower transverse rear edge area 42 of the float, it gradually lifts the float upwardly towards the inner surface 12 of the roof pivoting around pin 34 and of course extends the curve rod 36 through the guide sleeve 23 so that the indicator disc 40 moves upwardly and in an arc away from the outer surface 12A of the roof as shown in stages in phantom in FIG. 1. The specific shape of the float 25 prevents grain from engaging over the upper surface thereof which in turn would prevent the float from rising, regardless of the type of grain being filled into the bin.

When the rod 36 is fully extended, it indicates to the operator that the supply of grain should be cut off to the hopper of the auger assembly. The spacing of the assembly of the indicator assembly below the upper end of the roof is sufficient to enable the auger to not only empty the hopper but also to empty the auger tube so that very little wastage or spillage occurs.

It will of course be appreciated that the indicator disc 40 and upper portion of the rod may be painted with fluorescent paint so that it can be easily become visible by means of a flashlight or the like at night or, alternatively, a microswitch may be incorporated to switch on a light particularly if a source of power is present conveniently to the grain bin.

As soon as the bin commences emptying, the indicator moves downwardly to the lowermost position ready for the next filling of the bin.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A fill indicator for grain bins and the like having a sloping roof; comprising in combination a mounting member for securement to the sloping roof, a substantially wedge shaped float with means pivotally secured at one end thereof to said mounting member to depend therefrom when installed, guide means secured adjacent the other end of said float and extending upwardly therefrom, and indicating means on the distal end of guide means, said float including a substantially planar upper surface having side edges extending substantially parallel to one another from the other end of said float towards said one end thereof and converging towards said one end and terminating in a mounting means adjacent said one end, a pair of sides depend downwardly and inwardly from said side edges to form a keel portion substantially parallel to the upper surface from said other end towards said one end, said keel then inclining upwardly towards said one end at which said keel substantially meets said upper surface at said pivotably secured means, said sides also converging towards said one end from the location at which the keel commences inclining upwardly.

2. The indicator according to claim 1 in which said guide means extends through said mounting member remote from the securement of said float thereto.

3. The indicator according to claim 1 in which said guide means includes an arcuately curved member.

4. The indicator according to claim 1 in which said guide means includes pivotal support means on said other end of said float to pivotally mount said distal end of said guide means to said float.

5. The indicator according to claim 1 in which said float is hollow, said indicator means comprising a disc secured to the distal end of said guide means perpendicular to the axis of said guide means from the said disc including a downwardly curved edge portion to limit the downward movement of said float and to act as a shield around said guide means.

6. The indicator according to claim 2 in which said float is hollow, said indicator means comprising a disc secured to the distal end of said guide means perpendicular to the axis of said guide means from the said disc including a downwardly curved edge portion to limit the downward movement of said float and to act as a shield around said guide means.

7. The indicator according to claim 3 in which said float is hollow, said indicator means comprising a disc secured to the distal end of said guide means perpendicular to the axis of said guide means from the said disc including a downwardly curved edge portion to limit the downward movement of said float and to act as a shield around said guide means.

8. The indicator according to claim 4 in which said float is hollow, said indicator means comprising a disc secured to the distal end of said guide means perpendicular to the axis of said guide means from the said disc including a downwardly curved edge portion to limit the downward movement of said float and to act as a shield around said guide means.

9. A fill indicator for grain bins and the like having a sloping roof, said indicator being secured to the inside surface of said sloping roof spaced from the upper end of said roof, said fill indicator including an elongated mounting member secured to said inner surface and extending substantially along the slope of said roof, means to secure said member to said inner surface, a substantially wedge shaped float with means pivotally secured at one end thereof to adjacent an upper or higher end of said mounting member and depending therefrom, guide means secured to said other end of said float and extending upwardly therefrom, said guide means extending freely through said elongated member and through said roof, and indicating means on the distal end of said guide means, said float including a substantially planar upper surface having side edges extending substantially parallel to one another from the other end of said float towards said one end thereof and converging towards said one end and terminating in a mounting means adjacent said one end, a pair of sides depend downwardly and inwardly from said side edges to form a keel portion substantially parallel to the upper surface from said other end towards said one end, said keel then inclining upwardly towards said one end at which said keel substantially meets said upper surface at said pivotably secured means, said sides also converging towards said one end from the location at which the keel commences inclining upwardly.

10. The indicator according to claim 9 in which said guide means extends through said mounting member remote from the securement of said float thereto.

11. The indicator according to claim 9 in which said guide means includes an arcuately curved member.

12. The indicator according to claim 9 in which said guide means includes pivotal support means on said other end of said float to pivotally mount said distal end of said guide means to said float.

13. The indicator according to claim 9 in which said float is hollow, said indicator means comprising a disc secured to the distal end of said guide means perpendicular to the axis of said guide means from the said disc including a downwardly curved edge portion to limit the downwardly movement of said float and to act as a shield around said guide means.

14. The indicator according to claim 10 in which said float is hollow, said indicator means comprising a disc secured to the distal end of said guide means perpendicular to the axis of said guide means from the said disc including a downwardly curved edge portion to limit the downwardly movement of said float and to act as a shield around said guide means.

15. The indicator according to claim 12 in which said float is hollow, said indicator means comprising a disc secured to the distal end of said guide means perpendicular to the axis of said guide means from the said disc including a downwardly curved edge portion to limit the downwardly movement of said float and to act as a shield around said guide means.

16. The indicator according to claim 11 in which said float is hollow, said indicator means comprising a disc secured to the distal end of said guide means perpendicular to the axis of said guide means from the disc including a downwardly curved edge portion to limit the downwardly movement of said float and to act as a shield around said guide means.

* * * * *